US008104634B2

(12) United States Patent
Gregg et al.

(10) Patent No.: US 8,104,634 B2
(45) Date of Patent: Jan. 31, 2012

(54) DRAIN PAN FOR MOUNTED WATER EQUIPMENT

(76) Inventors: Matthew Scott Gregg, Mechanicsville, VA (US); Franklin Shearwood Brizendine, Jr., Dunnsvile, VA (US)

( * ) Notice: Subject to any disclaimer, the term of this patent is extended or adjusted under 35 U.S.C. 154(b) by 218 days.

(21) Appl. No.: 12/405,492

(22) Filed: Mar. 17, 2009

(65) Prior Publication Data

US 2010/0084303 A1 Apr. 8, 2010

Related U.S. Application Data

(60) Provisional application No. 61/194,924, filed on Oct. 2, 2008.

(51) Int. Cl.
*B65D 1/34* (2006.01)
*B65D 25/24* (2006.01)

(52) U.S. Cl. ..... 220/571; 220/476

(58) Field of Classification Search ..... 220/476, 220/480–483, 571
See application file for complete search history.

(56) References Cited

U.S. PATENT DOCUMENTS 5,339,676 A * 8/1994 Johnson ..... 73/40
5,641,007 A * 6/1997 Falk ..... 141/106
2006/0226172 A1 * 10/2006 Fowler et al. ..... 222/108

* cited by examiner

*Primary Examiner* — Harry Grosso
(74) *Attorney, Agent, or Firm* — Maier & Maier, PLLC

(57) ABSTRACT

A drain pan and drainage system is herein disclosed. The drain pan includes a basin with a wall mount connected to the basin. A drain hole is formed in a bottom surface of the basin. The drain pan also includes at least one side panel connecting the basin and the wall mount. The drainage system includes a wall, drain pan and water containing device. The water containing device is mounted to the drain pan and both are mounted to the wall. The water containing device and drain pan are mounted in such a way that the water containing device is at least partially enclosed by the drain pan.

23 Claims, 3 Drawing Sheets

DRAIN PAN FOR MOUNTED WATER EQUIPMENT

RELATED APPLICATIONS

This application claims priority, under 35 U.S.C. §119(e), to U.S. Provisional Patent Application Ser. No. 61/194,924, filed Oct. 2, 2008, the disclosure of which is incorporated by reference herein in its entirety.

BACKGROUND

Water containing devices are often used within buildings or dwellings. These buildings may encompass both residential and commercial buildings. These water containing devices can include any type of tankless water heater, wall mounted condensing or non-condensing boilers, steam generators or any other wall mounted equipment or devices that contain or transfer water or liquid that may require leak protection or drainage.

Traditionally there have not been drain pans available or used in conjunction with tankless water heaters or with other wall mounted equipment requiring them. Most plumbing codes require the use of a drain pan for water heaters when they are installed in a structure where a leak from the water heater or its piping could cause damage to the wall or surrounding structure.

Common practice among installers of these water containing products often results in the omitting of a drain pan altogether or use of a floor mounted drain pan designed for different equipment and is not designed for or compatible with the installed water containing product, especially to the extent required to satisfy plumbing and building codes or a code official.

SUMMARY

In at least one embodiment, a drain pan apparatus is disclosed. The drain pan can include a basin with a wall mount connected to the basin. A drain hole can be formed in a bottom surface of the basin. The drain pan can also include at least one side panel connecting the basin and the wall mount.

In another embodiment, a drain pan apparatus is disclosed. The drainage system can include a wall, drain pan and water containing device. The water containing device can be mounted to the drain pan and both can be mounted to the wall. The water containing device and drain pan may be mounted in such a way that the water containing device is at least partially enclosed by the drain pan.

In another embodiment, a drain pan apparatus is disclosed. The drainage system can include a wall, drain pan and water containing device. The water containing device can be mounted to the wall and the drain pan can be mounted to the wall. The water containing device and drain pan may be mounted in such a way that the water containing device is at least partially enclosed by the drain pan.

BRIEF DESCRIPTION OF THE FIGURES

Advantages of embodiments of the present invention will be apparent from the following detailed description of the exemplary embodiments thereof, which description should be considered in conjunction with the accompanying drawings in which.

DETAILED DESCRIPTION

Aspects of the drainage system are disclosed in the following description and related drawings directed to specific embodiments of the drainage system. Alternate embodiments may be devised without departing from the spirit or the scope of the drainage system. Additionally, well-known elements of exemplary embodiments of the drainage system will not be described in detail or will be omitted so as not to obscure the relevant details of the drainage system. Further, to facilitate an understanding of the description discussion of several terms used herein follows.

The word "exemplary" is used herein to mean "serving as an example, instance, or illustration." Any embodiment described herein as "exemplary" is not necessarily to be construed as preferred or advantageous over other embodiments. Likewise, the terms "embodiments of the drainage system" or "embodiments" do not require that all embodiments of the drainage system include the discussed feature, advantage or mode of operation.

As generally shown in FIGS. 1*a*-4, an exemplary drainage system can include a drain pan 10. The drain pan 10 can be used with a water or liquid containing device 20. The water containing device 20 may be, for example, any type of tankless water heater, wall mounted condensing or non-condensing boilers, steam generators or any other wall mounted equipment or device that contains, heats or transfers water or liquid that may require leak protection or drainage. Many water containing devices 20 are physically attached to interior or exterior walls of buildings, both commercial and residential.

In an exemplary embodiment the drain pan 10 can be formed, for example, to protect the structure of a building from potential water damage resulting from potential leaks of a water containing device 20, a tankless water heater for example, or from the piping 22*a* and 22*b* serving as the water intake and outlet. The drain pan 10 can be formed in a variety of shapes and sizes. In an exemplary embodiment, as shown in FIGS. 1*a*-4, the drain pan 10 can be formed to provide protection from splashing and spraying water by partially enclosing the water containing device 20 or piping 22*a* and 22*b*.

In another exemplary embodiment the drain pan 10 can be mounted to the same mounting structure or wall 30 as the water containing device 20 and thereby provide water protection to surrounding areas of the wall 30 or other surrounding structure. The drain pan 10 can be shaped to have a low profile so as to decrease the required surrounding space.

Figure 1A:
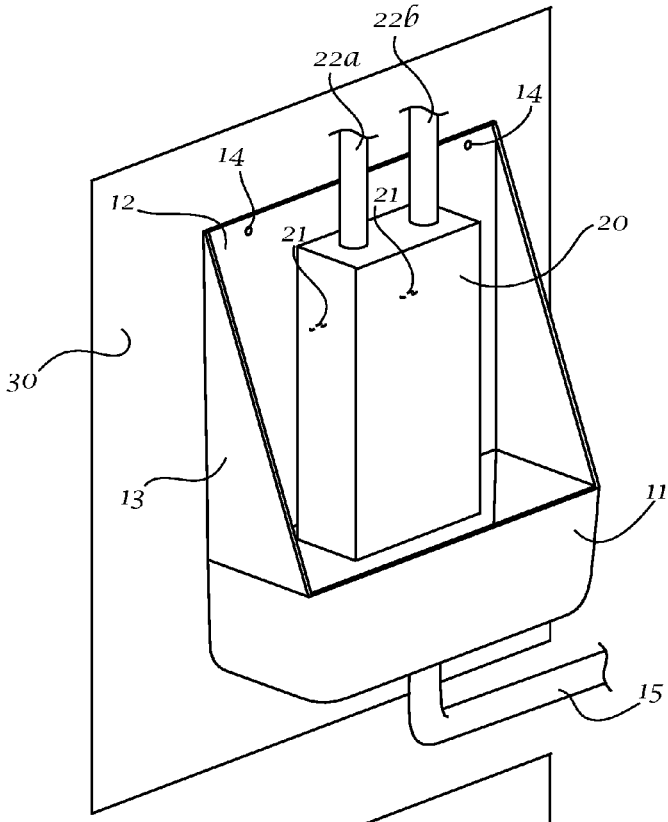
FIG. 1*a* is a perspective view of an exemplary embodiment of a drainage system.
Figure 1B:
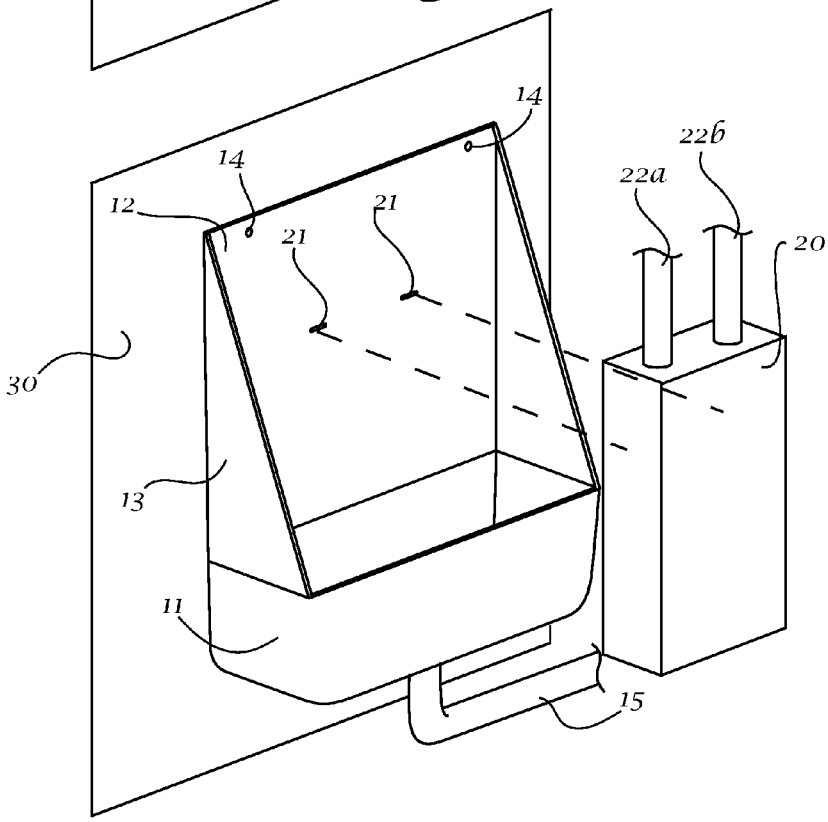
FIG. 1*b* is an exploded perspective view of an exemplary embodiment of a drainage system.

As shown in FIGS. 1*a* and 1*b*, water containing device 20 can be mounted to the drain pan 10 and the wall 30 simultaneously. This configuration can provide various mounting configurations, for example, the drain pan 10 can be mounted to the wall 30 either below the water containing device 20 or in such a way that the water containing device 20 is at least partially within or enclosed by the drain pan 10. The drain pan 10 can be mounted to a wall 30 or alternate structure via bolts, screws or other desired fastening device through the mounting holes 14 on a mounting plate 12. The water containing device 20 can also be mounted to the wall 30 via bolts, screws or other desired fastening device through the mounting holes 21 on the mounting plate 12, which can ultimately connect or mount the water containing device 20 to both the wall 30 and the drain pan 10.

Figure 3:
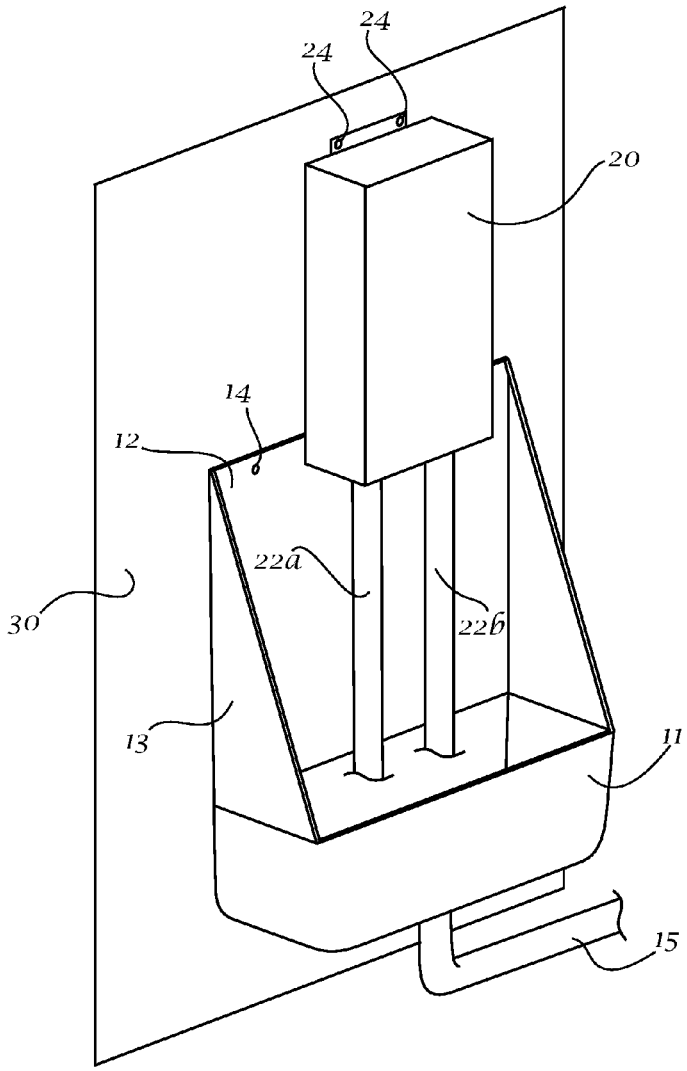
FIG. 3 is a perspective view of another exemplary embodiment of a drainage system.

In another exemplary embodiment, as shown in FIG. 3, water containing device 20 can be mounted to the wall 30 and the drain pan 10 can be mounted to the wall 30 at different mounting points. This configuration can provide various mounting configurations, for example, the drain pan 10 can be mounted to the wall 30 either below the water containing device 20 or in such a way that the water containing device 20 is at least partially within or enclosed by the drain pan 10 or in such a way that piping 22*a* and 22*b* are at least partially within or enclosed by the drain pan 10. The drain pan 10 can be mounted to a wall 30 or alternate structure via bolts, screws or other desired fastening device through the mounting holes 14 on a mounting plate 12. The water containing device 20 can also be mounted to the wall 30 via bolts, screws or other desired fastening device through mounting holes 24 on the water containing device 20, such that the water containing device 20 and drain pan 10 are independently connected or mounted to wall 30.

Figure 2A:
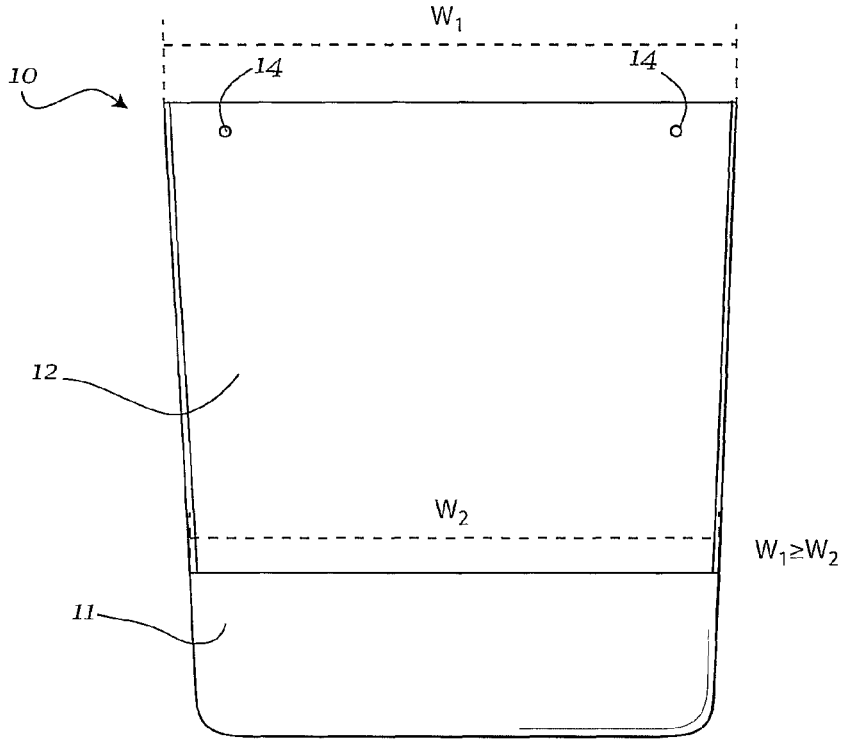
FIG. 2*a* is a front view of an exemplary embodiment of a drain pan.
Figure 2B:
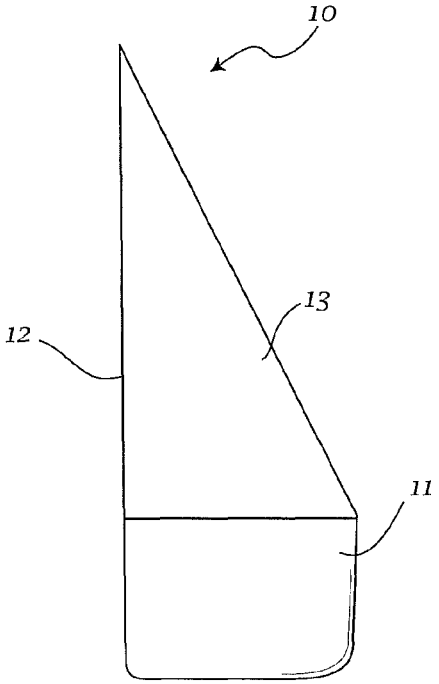
FIG. 2*b* is a side view of an exemplary embodiment of a drain pan.
Figure 2C:
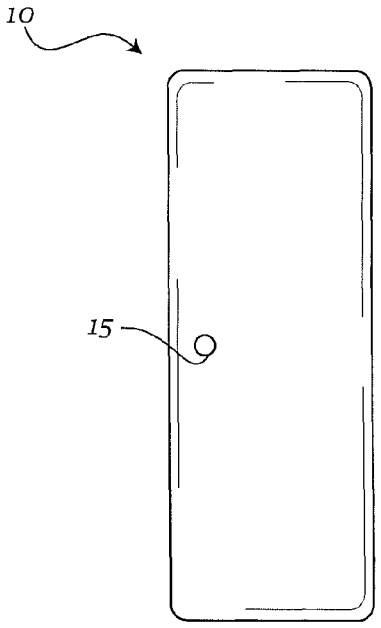
FIG. 2*c* is a bottom view of an exemplary embodiment of a drain pan.

In an exemplary embodiment, the drain pan 10 can include basin 11 which can act as a drainage conduit or funnel for water or other fluid that may leak from the water containing device 20. The basin 11 can include four side walls, each tapered and narrowing in width toward the bottom surface of the basin 11. For example, the top edge of one of the sidewalls can have a width of about 10" at a top edge and a width of about 9.5" on the bottom edge. The size and shape of the side walls may vary according to the specific application or any other desired configuration. The connection of the side walls and the bottom surface can be formed as edged corners or they can be rounded as shown in FIGS. 2*a*-2*c*.

The mounting plate 12 can be integrally formed with basin 11 and may also be formed with a tapered shape or any other desired shape. For example, mounting plate 12 can have a top edge with a width of about 19" and a width of about 18" on a bottom edge. The size and shape of the mounting plate may vary according to the specific application or any other desired configuration. The basin 11 may also include a drain hole 15 that may be formed to incorporate a standard drain fitting 15, for example about 1", typical with and compatible with other drain pans potentially on the market and in common use in the plumbing and heating industries.

Figure 4:
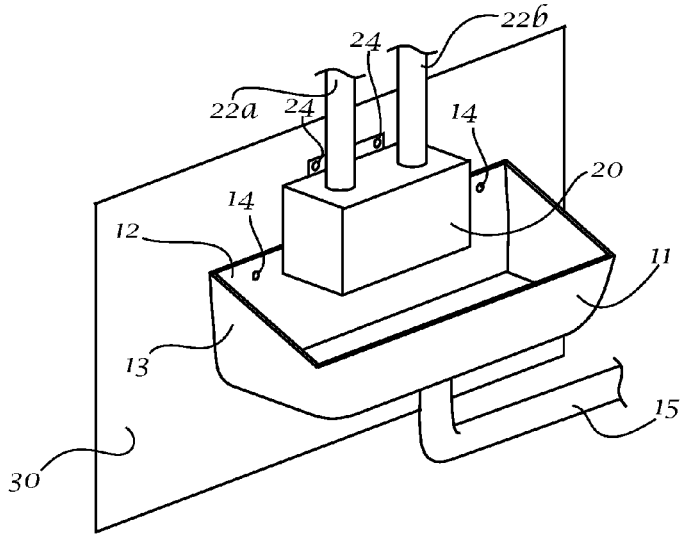
FIG. 4 is a perspective view of another exemplary embodiment of a drainage system.

In another exemplary embodiment, as shown in FIG. 4, drain pan 10 may have a low-profile configuration. For example, mounting plate 12 can have a top edge with a width of about 19" and a height of about 5", while the basin 11 can have a front wall with a height of about 2". The size and shape of the side walls may vary according to the specific application or any other desired configuration. The connection of the side walls and the bottom surface can be formed as edged corners or they can be rounded. The size and shape of the mounting plate may vary according to the specific application or any other desired configuration. The basin 11 may also include a drain hole 15 that may be formed to incorporate a standard drain fitting 15, for example about 1", typical with and compatible with other drain pans potentially on the market and in common use in the plumbing and heating industries.

The drain pan may also include side panels 13. These side panels 13 can be tapered from their top edge to basin 11 in such a way as to add structural strength between the mounting plate 12 and the basin 11. The side panels 13 may also increase splash/spray protection for wall 30 or surrounding structure from the water containing device 30 or piping 22*a* and 22*b*.

The drain pan 10 can be formed or manufactured of polymer material by thermoform process or any other process deemed appropriate to provide a proper finished product. The drain pan 10 may also be formed or manufactured of metal material or any other desired material capable of funneling or channeling water and retaining a rigid shape. The drain pan 10 material can also have significant strength to enable a water containing device to be mounted thereto by bolts, screws, other fasteners or connecting material.

The drain pan 10 may also be manufactured in alternative sizes and shapes as requested by other equipment manufacturers not limited to tankless water heaters, boilers or other water containing devices mentioned above, to meet their specific size needs. The size and shape of the drain pan 10 can also enable "nesting" in boxes of multiple pans to facilitate easier and more economical shipping and storage.

This drain pan 10 can also protect against the potential leaking from water containing devices without taking up floor space which is one of the positive attributes of using devices such as tankless water heaters or wall mounted boilers. Furthermore, the drain pan 10 can also be manufactured to size and shape specifications to serve other pieces of wall mounted equipment requiring protective drain pans.

This drain pan 10 can save consumers and insurance companies exorbitant costs in water damage repairs from failures of above mentioned water retaining equipment and related piping as well as potentially provide for a safe and efficient system for drain protection of other equipment such as relief valves, condensate drains, backflow preventers, etc. without compromising valuable floor space.

The foregoing description and accompanying drawings illustrate the principles, preferred embodiments and modes of operation of the invention. However, the drain pan and drainage system should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the drain pan and drainage system as defined by the following claims.

What is claimed is:

1. A drain pan comprising:

a basin;

a mounting plate connected to the basin;

a water containing device at least partially coupled to the mounting plate, wherein the water containing device is at least one of a tankless water heater, condensing boiler, non-condensing boiler or steam generator a drain hole in a bottom surface of the basin; and at least one side panel connected to the basin and the mounting plate, wherein the at least one side panel is formed in a tapered shape, wherein the mounting plate is formed in a tapered shape.

2. The drain pan of claim 1, wherein the tapered shape of the at least one side panel has the greatest width at a location adjacent to the basin.

3. The drain pan of claim 1, wherein the tapered shape of the mounting plate has the narrowest width at a location adjacent to the basin.

4. The drain pan of claim 1, wherein the basin includes four side walls integral with the bottom surface, wherein each of the four side walls are formed in a tapered shape having the narrowest width at locations adjacent to the bottom surface.

5. The drain pan of claim 1, wherein the mounting plate, the at least one side wall and the basin are formed in such a way as to enable nested stacking of multiple drain pans.

6. A drainage system comprising:

a wall;

a drain pan; and a water containing device, wherein the water containing device is at least one of a tankless water heater, condensing boiler, non-condensing boiler or steam generator mounted to the wall and the drain pan is mounted to the wall in such a way that the water containing device is at least partially enclosed by the drain pan.

7. The drainage system of claim 6, wherein the drain pan includes:

a mounting plate, wherein the wall is in direct contact with a first side of the mounting plate and the water containing device is in direct contact with a second side of the mounting plate.

8. The drainage system of claim 6, wherein the drain pan includes:

a basin;

a mounting plate connected to the basin;

a drain hole in a bottom surface of the basin; and at least one side panel connected to the basin and the mounting plate.

9. The drain pan of claim 8, wherein the at least one side panel is formed in a tapered shape.

10. The drain pan of claim 9, wherein the tapered shape of the at least one side panel has the greatest width at a location adjacent to the basin.

11. The drain pan of claim 8, wherein the mounting plate is formed in a tapered shape.

12. The drain pan of claim 11, wherein the tapered shape of the mounting plate has the narrowest width at a location adjacent to the basin.

13. The drain pan of claim 8, wherein the basin includes four side walls integral with the bottom surface, wherein each of the four side walls are formed in a tapered shape having the narrowest width at locations adjacent to the bottom surface.

14. The drain pan of claim 8, wherein the mounting plate, the at least one side wall and the basin are formed in such a way as to enable nested stacking of multiple drain pans.

15. A drainage system comprising:

a wall;

a drain pan; and a water containing device, wherein the water containing device is at least one of a tankless water heater, condensing boiler, non-condensing boiler or steam generator mounted to the drain pan and the wall simultaneously in such a way that the water containing device is at least partially enclosed by the drain pan.

16. The drainage system of claim 15, wherein the drain pan includes:

a mounting plate, wherein the wall is in direct contact with a first side of the mounting plate and the water containing device is in direct contact with a second side of the mounting plate.

17. The drainage system of claim 15, wherein the drain pan includes:

a basin;

a mounting plate connected to the basin;

a drain hole in a bottom surface of the basin; and at least one side panel connected to the basin and the mounting plate.

18. The drain pan of claim 17, wherein the at least one side panel is formed in a tapered shape.

19. The drain pan of claim 18, wherein the tapered shape of the at least one side panel has the greatest width at a location adjacent to the basin.

20. The drain pan of claim 17, wherein the mounting plate is formed in a tapered shape.

21. The drain pan of claim 20, wherein the tapered shape of the mounting plate has the narrowest width at a location adjacent to the basin.

22. The drain pan of claim 17, wherein the basin includes four side walls integral with the bottom surface, wherein each of the four side walls are formed in a tapered shape having the narrowest width at locations adjacent to the bottom surface.

23. The drain pan of claim 17, wherein the mounting plate, the at least one side wall and the basin are formed in such a way as to enable nested stacking of multiple drain pans.

* * * * *